US009630067B2

(12) United States Patent
Kohno et al.

(10) Patent No.: US 9,630,067 B2
(45) Date of Patent: Apr. 25, 2017

(54) GOLF CLUB

(71) Applicant: DUNLOP SPORTS CO. LTD., Kobe-shi, Hyogo (JP)

(72) Inventors: Daisuke Kohno, Kobe (JP); Yuki Motokawa, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

(21) Appl. No.: 14/950,693

(22) Filed: Nov. 24, 2015

(65) Prior Publication Data

US 2016/0144245 A1 May 26, 2016

(30) Foreign Application Priority Data

Nov. 25, 2014 (JP) ..... 2014-238288

(51) Int. Cl.
*A63B 53/02* (2015.01)
*A63B 53/06* (2015.01)
*A63B 71/06* (2006.01)

(52) U.S. Cl.
CPC ..... *A63B 53/02* (2013.01); *A63B 53/06* (2013.01); *A63B 2053/022* (2013.01); *A63B 2053/023* (2013.01); *A63B 2053/025* (2013.01); *A63B 2053/026* (2013.01); *A63B 2053/027* (2013.01); *A63B 2071/0694* (2013.01)

(58) Field of Classification Search
CPC ..... A63B 2053/025; A63B 53/02; A63B 2053/026; A63B 2053/023; A63B 2053/022; A63B 2053/027; A63B 53/06
USPC ..... 473/307, 305, 309, 310, 311
See application file for complete search history.

(56) References Cited

U.S. PATENT DOCUMENTS

| | | | | |
|---|---|---|---|---|
| 6,368,230 | B1 * | 4/2002 | Helmstetter | A63B 53/02 473/244 |
| 8,715,103 | B1 * | 5/2014 | Aguinaldo | A63B 53/02 473/246 |
| 8,753,221 | B1 * | 6/2014 | Aguinaldo | A63B 53/02 473/246 |
| 2007/0078026 | A1 * | 4/2007 | Holt | A63B 53/00 473/305 |
| 2010/0035701 | A1 * | 2/2010 | Kusumoto | A63B 53/02 473/307 |

FOREIGN PATENT DOCUMENTS

| | | | |
|---|---|---|---|
| JP | 2013-500059 | A | 1/2013 |
| WO | WO 2011/011321 | A1 | 1/2011 |

* cited by examiner

*Primary Examiner* — Benjamin Layno
(74) *Attorney, Agent, or Firm* — Birch, Stewart, Kolasch & Birch, LLP

(57) ABSTRACT

A golf club includes a shaft, a golf club head, a first adapter, a second adapter, and a fixing member that detachably fixes the second adapter to the first adapter. An internal space of the golf club head has a housing portion for housing the second adapter, and the housing portion is configured to regulate movement of the second adapter. A third opening portion that communicates with the housing portion and in which the second adapter can be inserted is formed in the surface of the golf club head. A first coupling portion of the first adapter is configured to incline relative to the shaft, and a second coupling portion of the second adapter is configured such that the first adapter is coupled at an angle to the second adapter.

9 Claims, 11 Drawing Sheets

95
70
42
7
73
96

GOLF CLUB

TECHNICAL FIELD

The present invention relates to a golf club.

BACKGROUND ART

In recent years, various methods for coupling a golf club head to a shaft have been proposed. For example, JP 2013-500059A discloses a golf club configured such that the attachment angle of the shaft to the golf club head can be changed by attaching two adapters between the golf club head and the shaft. Specifically, the golf club is configured as follows. First, an opening that communicates with a hosel portion is formed in a sole portion that is on the opposite side to the hosel portion, and a head adapter is inserted through this opening. Meanwhile, a shaft adapter to be attached to the shaft is fixed at an angle to the shaft. The shaft adapter is inserted into the hosel portion in this state and coupled to the head adapter. This head adapter is configured to be removably attached to the head in a plurality of rotation positions. The shaft adapter is configured to be fitted at an angle to the head adapter in the plurality of rotation positions of the head adapter.

Accordingly, with this golf club, two rotation positions, namely, the rotation position of the head adapter relative to the hosel portion and the rotation position of the shaft adapter relative to the head adapter, can be adjusted, and, as a result, the shaft can be attached at various angles to the golf club head. This enables the lie angle, loft angle and face angle of the golf club to be adjusted according to the user's preference.

SUMMARY OF INVENTION

Incidentally, with a golf club such as described above, the head adapter is attached through an opening portion on the sole portion side, thus requiring a large opening portion to be formed in the sole portion. However, there is a problem in that since a large opening is formed on the sole portion side, the center of gravity of the head is raised.

The present invention was made in order to solve the above problem, and has an object to provide, with respect to a golf club in which the shaft and the golf club head can be coupled at a plurality of angles using at least two adapters, a golf club that is able to prevent the center of gravity of the head from being raised.

A golf club according to the present invention is provided with a shaft, a golf club head including a sole portion and a hosel portion that has a first opening portion in which the shaft is to be attached, and having an internal space that extends from the first opening portion to the sole portion side, with the internal space being open at a second opening portion formed in the sole portion, a first adapter having a first end portion and a second end portion, and configured to be inserted into the first opening portion, the first adapter having, at the first end portion side, a shaft-insertion recessed portion in which the shaft is to be fixed and having, at the second end portion, a first coupling portion, a second adapter configured to be housed in the internal space and having a second coupling portion configured to be detachably coupled to the first coupling portion of the first adapter, and a fixing member configured to be housed in the internal space through the second opening portion, and to detachably fix the second adapter to the first adapter. The internal space includes a housing portion configured to house the second adapter, the housing portion is configured to regulate movement of the second adapter, a third opening portion that communicates with the housing portion and through which the second adapter is to be inserted is formed in a surface of the golf club head between the first opening portion and the second opening portion, the first coupling portion of the first adapter is configured to incline relative to the shaft, the second coupling portion of the second adapter is configured such that the first adapter is coupled at an angle to the second adapter, the first coupling portion of the first adapter and the second coupling portion of the second adapter are configured to be coupled in a plurality of rotation positions, and the second adapter is configured to be housed within the housing portion in a plurality of rotation positions.

In the above golf club, the first adapter has the first end portion and the second end portion at either end portion of a first axis and is formed in a tubular shape along the first axis, and the shaft-insertion recessed portion extends along a second axis that intersects the first axis. The second adapter has a first end portion that faces the first opening portion side and a second end portion that faces the second opening portion side, the first end portion and the second end portion are provided at either end portion of a first axis, and the second coupling portion is formed along a second axis that intersects the first axis. The first coupling portion of the first adapter and the second coupling portion of the second adapter are configured to be coupled in a plurality of rotation positions about the second axis of the second adapter, and the second adapter is configured to be housed within the housing portion in a plurality of rotation positions about the first axis of the second adapter.

In the above golf club, the first coupling portion of the first adapter has a tubular protruding portion, and the second coupling portion of the second adapter has a recessed portion that is configured to accept the first coupling portion of the first adapter.

In the above golf club, the second adapter is formed to have an outer peripheral surface having a polygonal shape in cross section, and is configured to be housed in a plurality of rotation positions with at least two faces of the outer peripheral surface abutting within the housing portion.

In any of the above golf clubs, in the second adapter, a coupling position with the first coupling portion of the first adapter is disposed in a position shifted from a center of the plurality of rotation positions within the housing portion.

In any of the above golf clubs, the second adapter is configured to be positioned by the surface facing the first opening portion side abutting against an inner wall surface within the internal space.

In any of the above golf clubs, at least one third adapter configured to be coupled to the first coupling portion of the first adapter at a different inclination angle from the second adapter is further provided, and the at least one third adapter is configured to be inserted through the third opening portion and housed in the internal space, and to be coupled to the first adapter by the fixing member.

In any of the above golf clubs, at least one third adapter configured to be coupled to the first coupling portion of the first adapter at the same inclination angle as the second adapter and having a different weight from the second adapter is further provided, and the at least one third adapter is configured to be inserted through the third opening portion and housed in the internal space, and to be coupled to the first adapter by the fixing member.

In the case of using the third adapter, a configuration can be adopted in which, for example, the golf club head is provided with at least one recessed portion capable of housing the second and third adapters.

Note that, in the present specification, the term "coupling" is used with regard to the relationship between the adapters and the relationship between the adapters and the hosel portion, with "coupling" being intended to mean that both members at least contact each other so as to not move but not necessarily to the extent that both members will remain unseparated when an external force is applied. Accordingly, apart from "coupling", this state can be expressed by the term "engaged".

According to the present invention, the center of gravity of the head can be prevented from being raised in a golf club that enables the shaft and the golf club head to be coupled at a plurality of angles using at least two adapters.

BRIEF DESCRIPTION OF DRAWINGS

FIGS. 11A and 115 are perspective views showing another embodiment of the second adapter.

DESCRIPTION OF EMBODIMENTS

Figure 1:
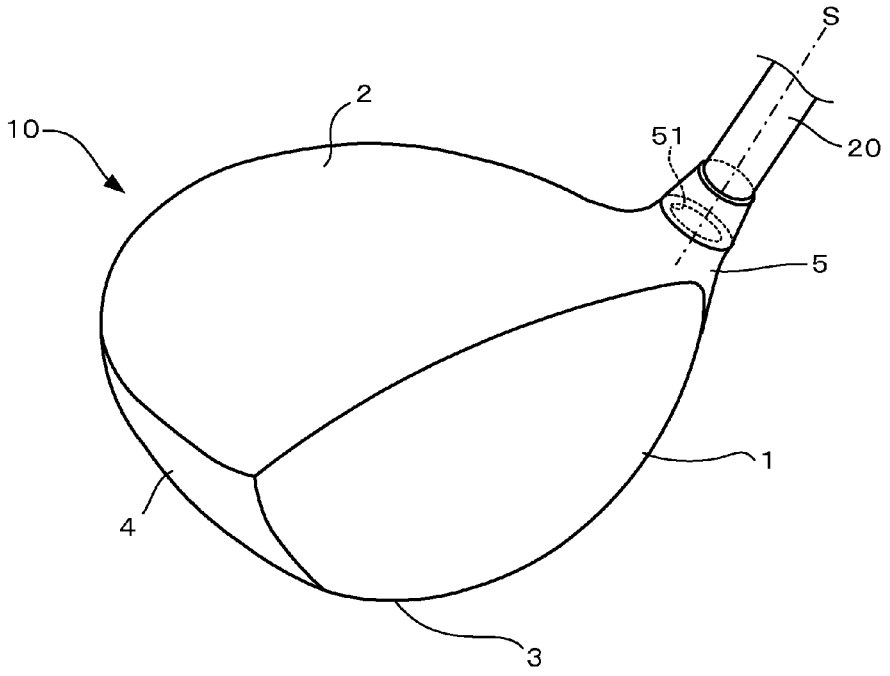
FIG. 1 is a perspective view of a golf club according to one embodiment of the present invention.
Figure 2:
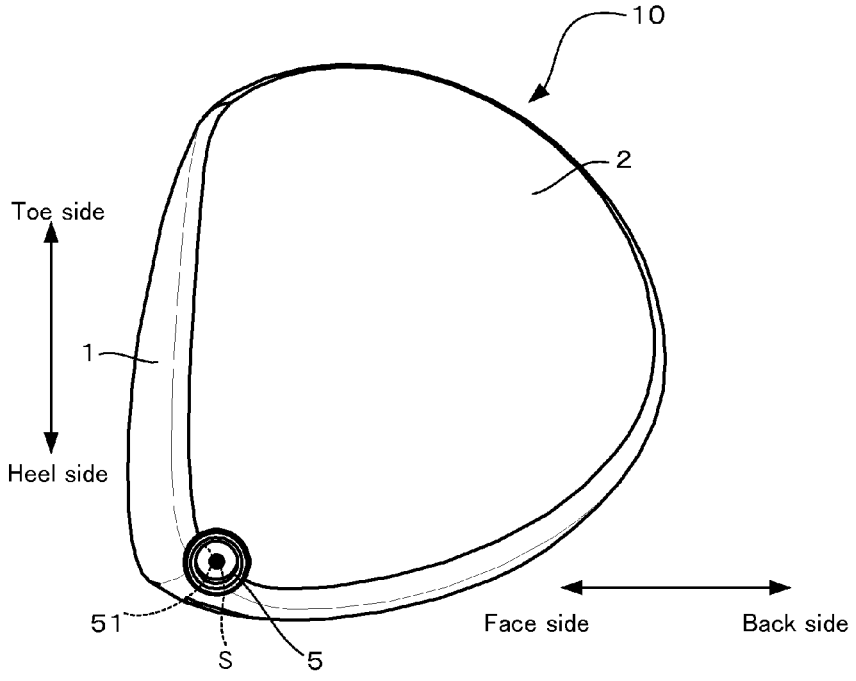
FIG. 2 is a plan view of FIG. 1.

Hereinafter, one embodiment of a golf club according to the present invention will be described with reference to the drawings. FIG. 1 is a perspective view of a golf club head according to the present embodiment, and FIG. 2 is a plan view of FIG. 1. In the following, description may be given on the basis of the orientation shown in the drawings, although this is for convenience of description, and this orientation does not limit the invention. Also, unless stated otherwise, in the following, the axial direction is roughly the direction in which the shaft extends, although this is not an exact definition.

1. Overall Structure of Golf Club

As shown in FIGS. 1 and 2, a golf club according to the present embodiment is provided with a shaft 20 and a golf club head 10 (hereinafter, may be simply referred to as "head") coupled to an end portion of the shaft. Also, the shaft 20 and the golf club head 10 are coupled using a coupling structure which will be discussed later, and are configured such that the rotation position of the head 10 can be changed about the axis of the shaft 20. Hereinafter, each member will be described in detail.

The shaft 20 is formed to have a hollow tubular shape, with the above-mentioned golf club head 10 coupled to a lower end portion and a grip which is not shown fixed to an upper end portion.

The golf club head 10 is a hollow structure, and a wall surface thereof is formed by a face portion 1, a crown portion 2, a sole portion 3, a side portion 4, and a hosel portion 5. The face portion 1 has a face surface which is the surface that strikes the ball, and the crown portion 2 adjoins the face portion 1 and constitutes an upper surface of the head 10. The sole portion 3 constitutes a bottom surface of the head 10, and adjoins the face portion 1 and the side portion 4. Also, the side portion 4 is a region between the crown portion 2 and the sole portion 3, and extends from the toe side of the face portion 1 to the heel side of the face portion 1 via the back side of the head 10. Furthermore, the hosel portion 5 is a cylindrical region that is provided adjoining the heel side of the crown portion 2, and has an attachment hole (first opening portion) 51 into which a first adapter 6 which will be discussed later is inserted. Also, a reference display 52 for positioning the rotation position of the after-mentioned first adapter 6 is provided on the heel side of the outer peripheral surface of this attachment hole 51 (see FIGS. 3 and 4). Note that the head 10 described here is a wood such as a driver or a fairway wood, but is not limited thereto, and may be a so-called utility, hybrid or the like, or an iron.

2. Coupling Structure of Shaft and Golf Club Head

Figure 3:
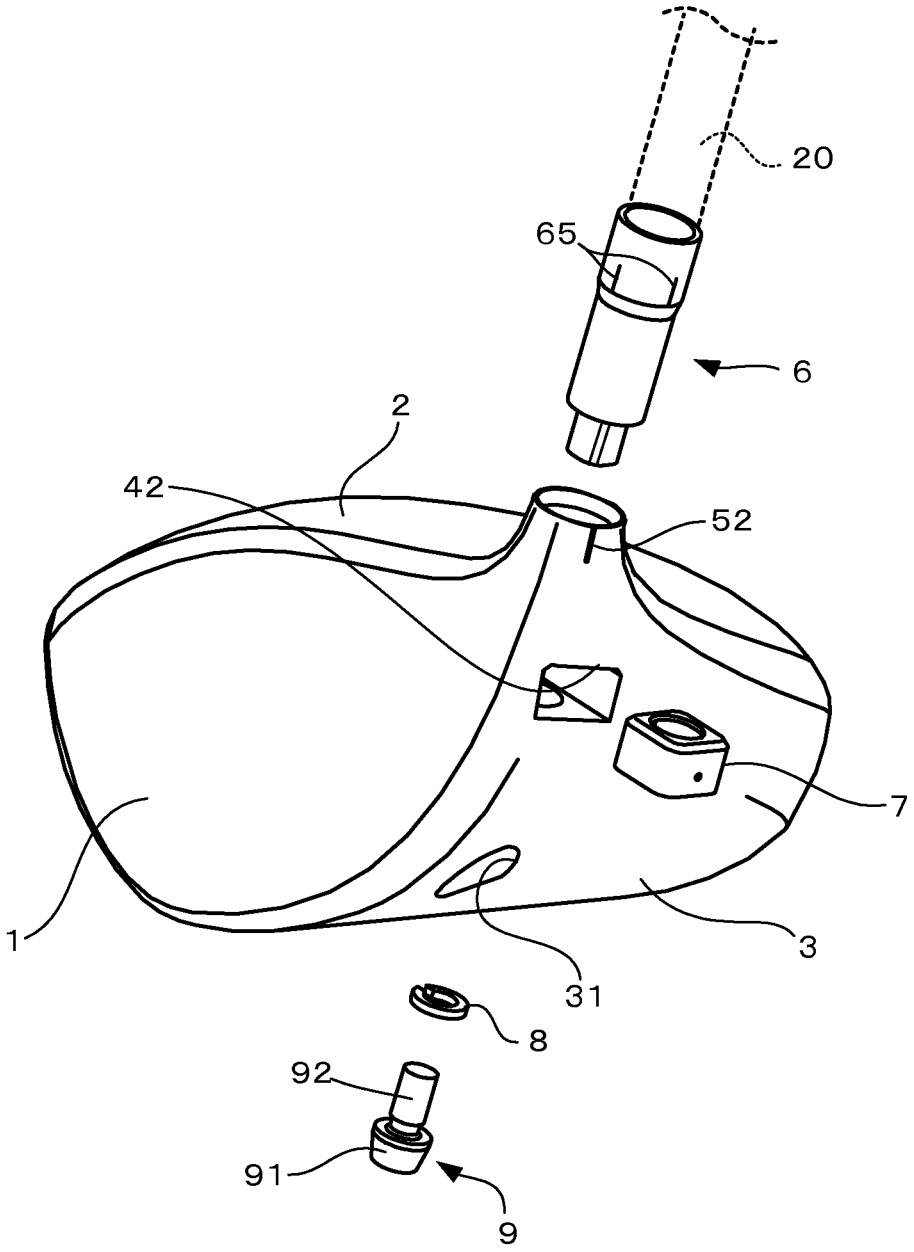
FIG. 3 is an exploded view of a coupling structure.

Next, the coupling structure of the shaft 20 and the golf club head 10 will be described. FIG. 3 is an exploded view of the coupling structure. As shown in the diagram, in this coupling structure, the shaft 20 and the golf club head 10 are coupled via a first adapter 6 and a second adapter 7, and these adapters 6 and 7 are both fixed inside the golf club head 10 by a washer 8 and a fixing member 9. Hereinafter, this coupling structure will be described in detail.

2.1 Structure Relating to Coupling of Golf Club Head

Figure 4:
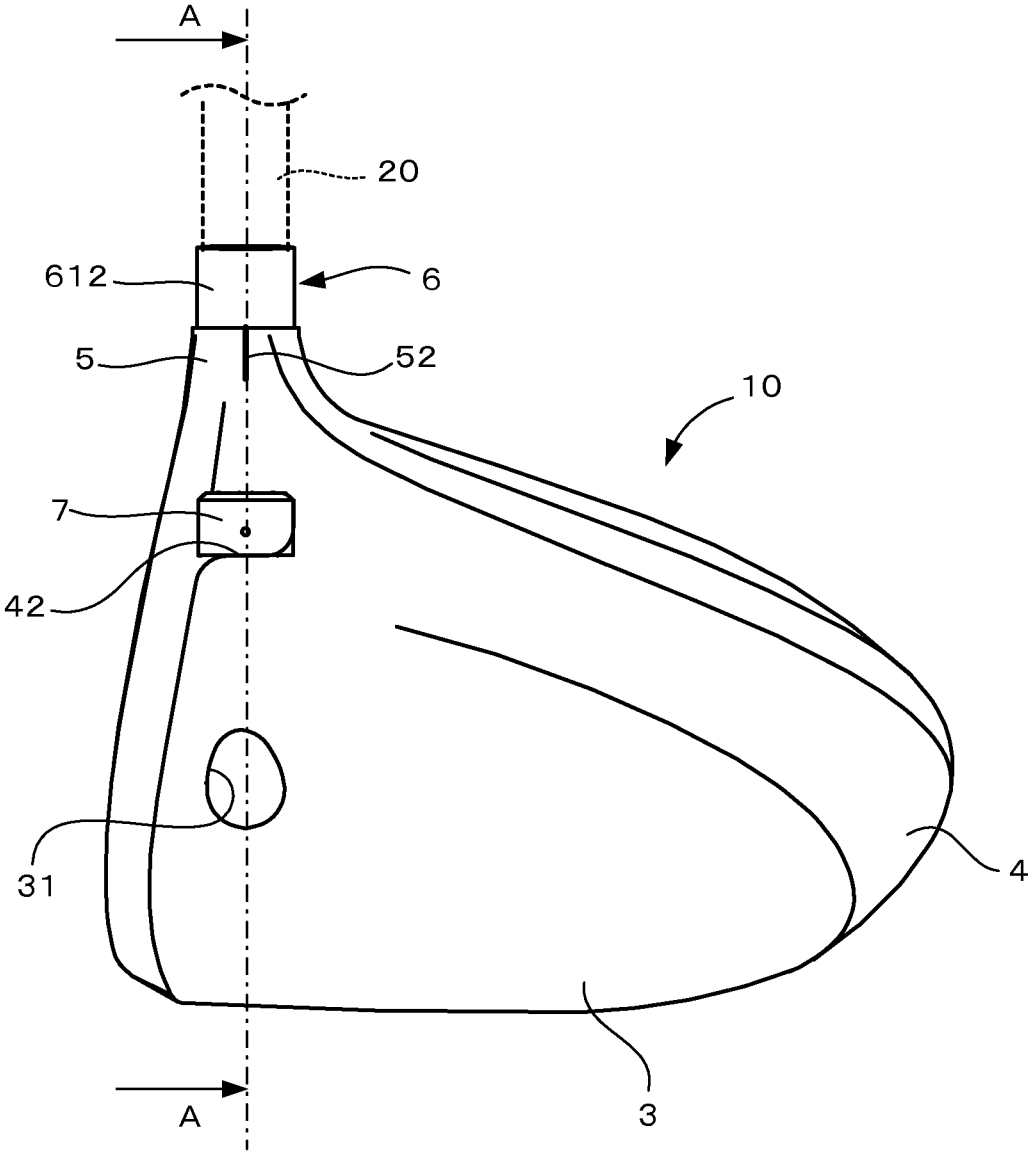
FIG. 4 is a diagram of a golf club head to which two adapters, a washer and a fixing member are mounted as seen from a heel side.

First, the structure of the golf club head 10 will be described, with reference also to FIGS. 4 and 6. FIG. 4 is a diagram of the golf club head to which the two adapters, the washer and the fixing member are mounted as seen from the heel side, FIG. 5 is a cross-sectional view along a line A-A in FIG. 4, and FIGS. 6A to 6C are respectively the cross-sectional view of FIG. 5 without the two adapters and the fixing member, an enlarged view of the side opening portion as seen from the heel side, and an enlarged view of a second area of the internal space as seen from above.

Figure 5:
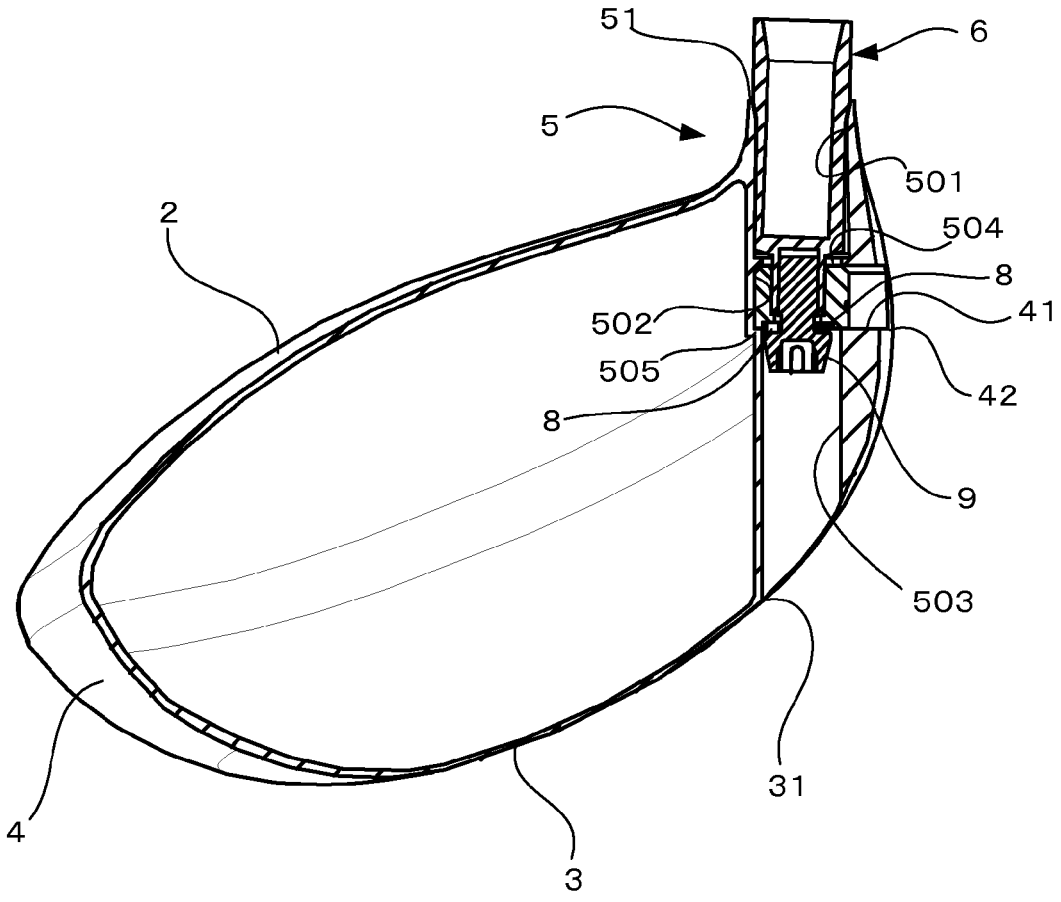
FIG. 5 is a cross-sectional view along a line A-A in FIG. 4.
Figure 6A:
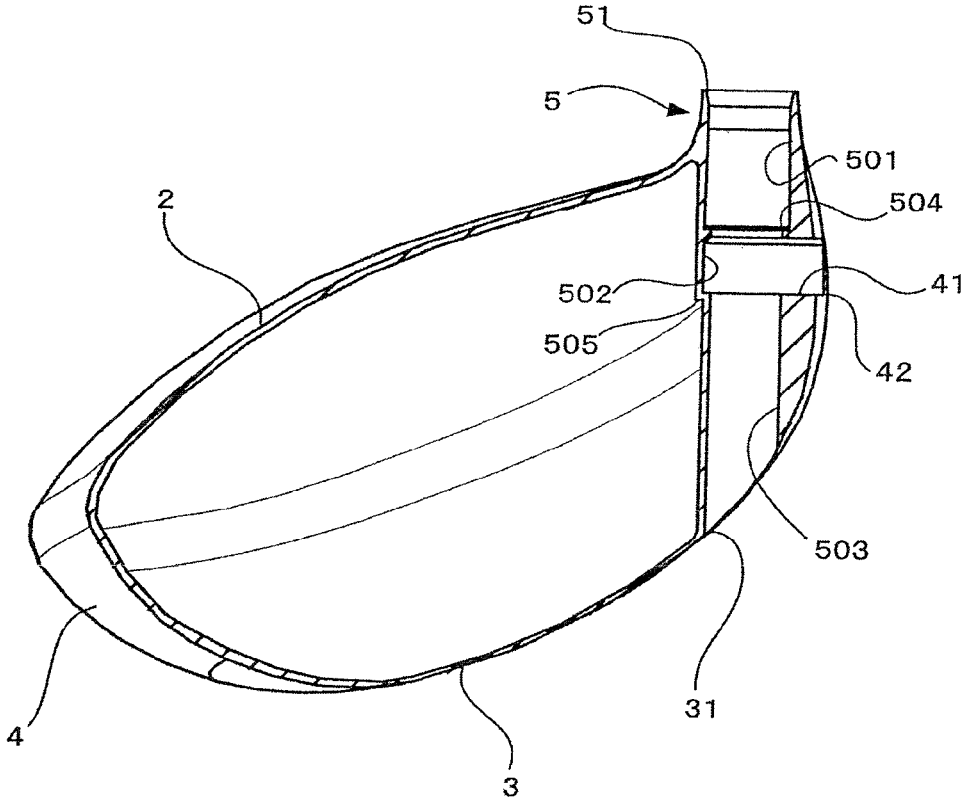
FIG. 6A is the cross-sectional view of FIG. 5 without the two adapters and the fixing member.
Figure 6B:
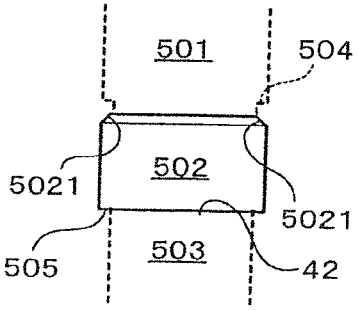
FIG. 6B is an enlarged view of a side opening portion as seen from the heel side, and FIG. 6C an enlarged view of a second area of an internal space as seen from above.
Figure 6C:
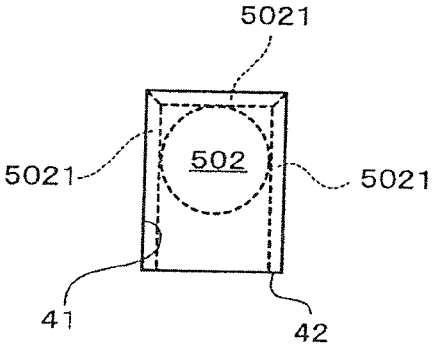

As shown in FIGS. 5 and 6, in this golf club head, a tubular internal space extending roughly parallel to the axial direction of the shaft 20 is formed from the attachment hole 51 in the hosel portion 5, and this internal space opens in the sole portion 3. Hereinafter, this opening in the sole portion 3 will be referred to as a sole opening portion (second opening portion) 31. Also, in the following, the direction in which the internal space extends may be referred to as the axial direction.

The internal space has the three areas aligned in the axial direction from the attachment hole 51 in the hosel portion 5, that is, a first area 501, a second area (housing portion) 502, and a third area 503. The first area 501 is formed in a cylindrical shape, and an inner wall surface thereof is formed in a tapered shape such that the diameter increases slightly from the attachment hole 51 in the hosel portion 5 toward the sole portion 3 side. The above-mentioned first adapter 6 is inserted into this first area 501.

The second area 502, which is the area that mainly houses the second adapter 7, is formed to have a rectangular parallelepiped internal shape in correspondence with the second adapter 7, and has a length in the axial direction that is substantially the same as the length of the second adapter 7 in the axial direction. A flange portion 504 extending inwardly in the diameter direction is formed on the boundary with the first area 501, and movement of the second adapter 7 is regulated by this flange portion 504, such that the second adapter 7 does not move to the attachment hole 51 side. Also, the inner diameter of this flange portion 504 is large enough to allow a coupling portion 62 of the first adapter 6 to be inserted, as will be discussed later, and the coupling portion 62 of the first adapter 6 projecting on the sole opening portion 31 side is coupled to the second adapter 7 via the flange portion 504.

Furthermore, the second area 502 communicates with an insertion space 41 extending in a direction orthogonal to the axial direction, and this insertion space 41 is open at the side portion 4. Hereinafter, this opening in the side portion 4 will be referred to as a side opening portion 42. According to this configuration, the second adapter 7 is configured to be inserted into the second area 502 of the internal space via the insertion space 41 through the side opening portion 42. Also, the insertion space 41 and the second area 502 communicate with each other as described above, and, as shown in FIG. 6C, are formed to have a rectangular shape in plan view, with tapered surfaces 5021 being formed at three locations on the upper surface, namely, on both side edges and the innermost edge. The portion of these tapered surfaces 5021 that is located in the second area 502 is formed on the lower surface of the above-mentioned flange portion 504.

The third area 503 extends in a cylindrical shape between the second area 502 and the sole opening portion 31. The inner diameter of the third area 503 is smaller than the outer diameter of the second area 502, and a stepped portion 505 is thereby formed on the boundary between the second area 502 and the third area 503. Movement of the second adapter 7 housed in the second area 502 to the third area 503 side is regulated by this stepped portion 505. Also, the washer 8 and the fixing member 9 are inserted into this third area 503 from the sole opening portion 31 side.

2.2 First Adapter

Figure 7A:
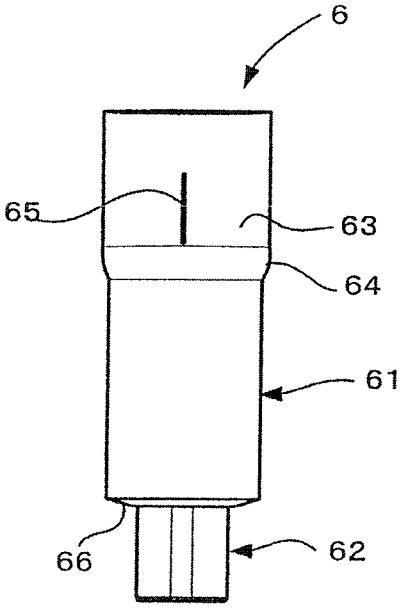
FIG. 7A is a side view and FIG. 7B a cross-sectional view of the first adapter.
Figure 7B:
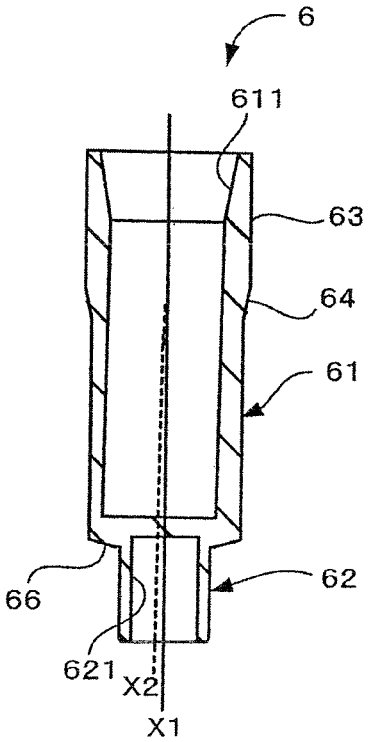

Next, the first adapter 6 will be described with reference to FIGS. 7A and 7B. FIG. 7A is a side view and FIG. 7B is a cross-sectional view of the first adaptor. As shown in these diagrams, the first adapter 6 is provided with a main body portion 61 formed into a tubular shape, a large diameter portion 63 attached to an upper end portion of this main body portion 61 and having a larger diameter than the main body portion 61, and a tubular coupling portion (first coupling portion) 62 attached to a lower end portion of this main body portion 61 and having a smaller diameter than the main body portion 61, with these portions being integrally formed. The main body portion 61 is axially centered on a first axis X1, and has an external shape that extends cylindrically along this first axis X1 and a shaft-insertion recessed portion 611 that is open on the upper end side. This shaft-insertion recessed portion 611 has a cylindrical inner wall surface extending along a second axis X2 that intersects the first axis X1 at an angle of approximately one degree, and a lower end portion of the shaft 20 is inserted into this shaft-insertion recessed portion 611. The shaft 20 is fixed to this shaft-insertion recessed portion 611 by adhesion or the like. An axial center S of the shaft 20 (see FIG. 1) is thereby fixed so as to extend along the second axis X2 of the first adapter 6 and to extend at an angle to the first adapter 6.

Also, the main body portion 61 of the first adapter 6 has an outer diameter that is smaller than the diameter of the attachment hole 51 in the hosel portion 5, and is disposed in the internal space of the hosel portion 5. On the other hand, the large diameter portion 63 has a larger diameter than the attachment hole 51, and a transition portion 64 that curves outwardly in the diameter direction is formed between this large diameter portion 63 and the main body portion 61. This transition portion 64 contacts the inner peripheral edge of the attachment hole 51 in the hosel portion 5. The transition portion 64 thereby readily comes in contact with the entire inner peripheral edge of the attachment hole 51 in the hosel portion 5, even in the case where the first adapter 6 inclines relative to the hosel portion 5. The first adapter 6 is swingable as a result of the portion where this transition portion 64 comes in contact with the attachment hole 51 in the hosel portion 5 being supported. Also, as illustrated in FIG. 3, for example, a plurality of rotation position displays 65 are provided (at four positions 90 degree apart on the outer peripheral surface of the large diameter portion 63 in the present embodiment), and an angle preferred by the user can be achieved by positioning one of these rotation position displays to line up with the reference display 52 that is provided on the peripheral edge of the opening in the attachment hole 51 in the hosel portion 5.

The coupling portion 62 of the first adapter 6 is formed in a square tubular shape extending along the first axis X1 and has a screw hole 621 that is open downward, and a female thread is formed in this screw hole 621. A screw portion 92 of the fixing member 9 is screwed into this female thread, as will be discussed later. Also, a stepped portion 66 between the main body portion 61 and the coupling portion 62 is formed so as to taper. As described above, the first adapter 6 is inserted into the first area 501 of the internal space of the head 10 through the attachment hole 51, and only the coupling portion 62 projects out from the flange portion 504 on the second area 502 side and is coupled to the second adapter 7. Note that the upper end portion of the first adapter 6 in FIG. 6 is equivalent to a first end portion of the present invention, and the lower end portion of the first adapter 6 is equivalent to a second end portion of the present invention.

2.3 Second Adapter

Figure 8A:
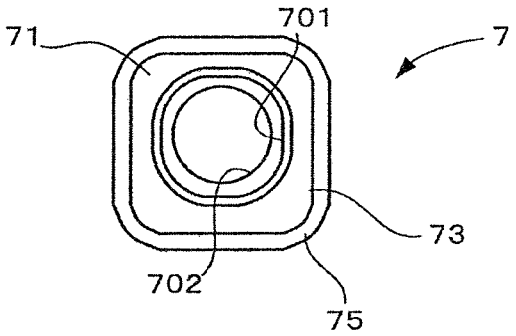
FIG. 8A is a plan view.
Figure 8B:
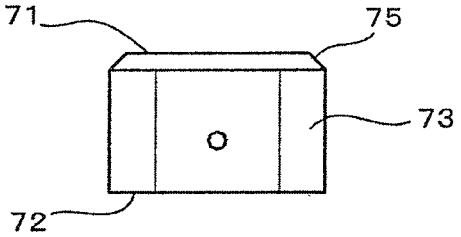
FIG. 8B is a side view and FIG. 8C is a cross-sectional view of a second adapter.
Figure 8C:
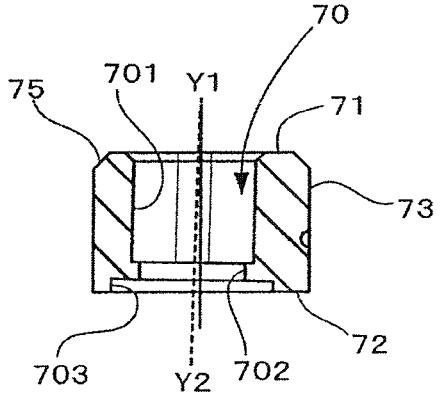

Next, the second adapter 7 will be described with reference to FIGS. 8A to 8C. FIG. 8A is a plan view, FIG. 8B is a side view and FIG. 8C is a cross-sectional view of the second adapter. As shown in the diagram, the second adapter 7 is formed in a rectangular parallelepiped shape, and is constituted by an upper surface 71, a lower surface 72, and an outer peripheral surface 73 consisting of four faces. The four faces of the outer peripheral surface 73 all have the same width. That is, this second adapter 7 is formed in a square shape in plan view. Also, the four sides of the upper surface 71 of the second adapter 7 are chamfered, and tapered surfaces 75 are formed.

As mentioned above, the second adapter 7 is configured to be housed in the second area 502 of the internal space of the head 10, and when housed in the second area 502, movement in the axial direction is regulated by the flange portion 504 and the stepped portion 505. Specifically, the inner wall surface of the second area 502 is formed so as to correspond to the outer peripheral surface 73 of the second adapter 7. That is, the two faces of the outer peripheral surface 73 that are parallel to the insertion direction of the second adapter 7 contact the inner wall surface of the second area 502, and the second adapter 7 is thereby housed in the second area 502 in an unrotatable manner. Three tapered surfaces 75 (forward tapered surface in the insertion direction and two tapered surfaces parallel to the insertion direction) of the upper surface of the second adapter 7 respectively abut against the three tapered surfaces 5021 formed on the upper surface of the second area 502 and the insertion space 41. The second adapter 7 can thereby be prevented from shifting in a direction (face-back direction) perpendicular to the insertion direction. Also, since the outer peripheral surface 73 of the second adapter 7 is square in plan view, the second adapter 7 can be accommodated in the second area 502 in any of four rotation positions.

Also, a through hole 70 extending in the up-down direction is formed in the second adapter 7. The second adapter 7 is axially centered on a first axis Y1 extending perpendicular to the upper surface 71 and the lower surface 72, and the through hole 70 has a cylindrical inner wall surface extending along a second axis Y2 that intersects the first axis Y1 at an angle of approximately one degree.

The through hole 70 is divided into three areas, and has a first area (second coupling portion) 701, a second area 702, and a third area 703 that are aligned in the axial direction from the upper surface 71 side. The first area 701 is open at the upper surface 71, and the coupling portion 62 of the first adapter 6 can be detachably inserted therein. Thus, the internal shape of the first area 701 is substantially the same square tubular shape as the external shape of the coupling portion 62 of the first adapter 6. Since the axis Y2 of the first area 701 inclines at approximately one degree relative to the axis Y1, the first adapter 6 that is attached thereto is fixed so as to extend at an angle to the second adapter 7. At this time, since the coupling portion 62 of the first adapter 6 and the first area 701 of the second adapter 7 are both formed in a square tubular shape, the coupling portion 62 of the first adapter 6 can be coupled to the second adapter 7 in four rotation positions.

Also, the second adapter 7 has an outer peripheral surface that is square in plan view, and is thus housed in the second area 502 of the head 10 in one of the four rotation positions. The first adapter 6 can be coupled in any of these four rotation positions of the second adapter 7. Thus, the second adapter 7 can be coupled at four angles to the first adapter 6, when housed in the second area 502 of the head 10. Note that the first axis X1 of the first adapter 6 is coaxial with the second axis Y2 of the second adapter 7. Accordingly, the second axis X2 of the first adapter 6 and the second axis Y2 of the second adapter 7 are configured so as intersect when both of the adapters 6 and 7 are coupled, rather than being parallel.

The third area 703 is open at the lower surface 72 of the second adapter 7, and is formed to have an inner diameter that allows the washer 8 to be fitted therein and to be deep enough to fit a portion of the washer 8. Accordingly, when the washer 8 is fitted into the third area 703, a portion of the washer 8 will project slightly from the lower surface 72 of the second adapter 7. The second area 702 is an area that communicates the first area 701 with the third area 703, and is formed to have a smaller diameter than the first area 701 and the third area 703. The first area 701, the second area 702 and the third area 703 of the through hole 70 that are thus formed extend along the second axis Y2. Note that the upper surface 71 of the second adapter 7 in FIG. 7 is equivalent to a first end portion of the present invention, and the lower surface of the second adapter 6 is equivalent to a second end portion of the present invention.

2.4 Coupling of Fixing Member and Washer to Second Adapter

The fixing member 9 is provided with a head portion 91 and a screw portion 92, and, as shown in FIG. 5, the washer 8 is pressed by the head portion 91, and the screw portion 92 is configured to pass through the third area 703 and the second area 702 from the lower surface side of the second adapter 7 and extend into the first area 701. The screw portion 92 is screwed into the coupling portion 62 of the first adapter 6 inserted into the first area 701. Here, the surface on which the washer 8 is disposed in the third area 703 of the second adapter is formed so as to be orthogonal to the second axis Y2. This is because the first adapter 6 coupled to the second adapter 7 extends along the second axis Y2, and the washer 8 and the fixing member 9 are configured to securely fix this first adapter 6 in correspondence with the direction in which the first adapter 6 extends.

Note that the adapters 6 and 7 that are used in the coupling structure can be formed with various materials, and can be formed with Ti (6-4Ti), Al (A7075) or the like, for example.

3. Assembly of Shaft and Golf Club Head

Next, the method of assembling a golf club having the above configuration will be described. First, the second adapter 7 is inserted through the side opening portion 42 of the side portion 4. At this time, having oriented the upper surface 71 of the second adapter 7 to face the attachment hole 51 side and oriented the lower surface 72 to face the sole opening portion 31 side, the rotation position is appropriately determined and the second adapter 7 is pushed into the second area 502 through the side opening portion 42 in the desired rotation position. Then, the first adapter 6 to which the shaft 20 is fixed is inserted into the attachment hole 51 in the hosel portion 5 with the coupling portion 62 oriented downward. At this time, one of the rotation position displays 65 of the large diameter portion 63 of the first adapter 6 is positioned at the reference display 52 on the peripheral edge of the attachment hole 51. The coupling portion 62 of the first adapter 6 is thus inserted into the second area 502 of the internal space and coupled in the through hole 70 in the second adapter 7 at one of the above-mentioned four rotation angles. Then, after the washer 8 has been inserted onto the screw portion 92 of the fixing member 9 and engaged with the head portion 91, the fixing member 9 is inserted through the sole opening portion 31. The washer 8 is thereby disposed in the third area 703 of the second adapter 7, and the screw portion 92 is inserted into the through hole 70 from the lower surface 72 side of the second adapter 7 and screwed into the coupling portion 62 of the first adapter 6. The first adapter 6 and the second adapter 7 are thus fixed to the hosel portion 5. At this time, the first adapter 6 abuts against the inner wall surface of the attachment hole 51 at the transition portion 64, but the stepped portion 66 of the first adapter 6 does not abut against the flange portion 504 and a gap is formed between the stepped portion 66 and the flange portion 504 (see FIG. 5). On the other hand, the upper surface of the second adapter 7 is pushed against the lower surface of the flange portion 504 by screwing the fixing member 9 into the first adapter 6.

4. Features

When the shaft 20 and the head 10 are fixed as described above, the shaft 20 is fixed so as to incline at an angle of approximately one degree relative to the first adapter 6. Also, the first adapter 6 is fixed so as to incline at an angle of approximately one degree relative to the second adapter 7. Accordingly, the shaft 20 will be fixed so as to incline at a maximum angle of approximately two degrees relative to the second adapter 7. Although the first adapter 6 is thus fixed so as to incline at one of the rotation positions relative to the second adapter 7, the first area 501 of the internal space in which the first adapter 6 is housed is formed in a tapered shape, and thus interference will not occur between the first adapter 6 and the inner wall surface of the first area 501 in any of the rotation positions at which the first adapter 6 is fixed to the second adapter 7.

Here, the attachment angle of the shaft 20 to the head 10 is changed when the rotation position of the first adapter 6 relative to the second adapter 7 is changed with the rotation position of the second adapter 7 fixed, enabling the lie angle, loft angle and face angle to be changed. The lie angle, loft angle and face angle can be further fine tuned by changing the rotation position of the second adapter 7, that is, the orientation in which the second adapter 7 is housed in the second area 502. For example, if the first adapter 6 can be rotated at four different angles relative to the second adapter 7 and the second adapter 7 can be rotated at four different angles relative to the second area 502, it is possible to change between a total of 16 different combinations of the lie angle, loft angle and face angle.

At this time, the user can readily visually confirm the rotation position of the first adapter 6 because of the rotation position displays 65 being provided on the large diameter portion 63 of the first adapter 6 and exposed to the outside. Also, since the outer peripheral surface 73 of the second adapter 7 disposed in the second area 502 can be sighted via the side opening portion 42 if a display is provided on each face of the outer peripheral surface 73 of the second adapter 7, for example, the user can visually confirm the rotation position of the second adapter 7 by checking this display. Accordingly, the user is able to check the rotation position of the first adapter 6 and the rotation position of the second adapter 7, and thereby confirm the lie angle, loft angle and face angle of this golf club, without disassembling the coupling structure. In particular, since the reference display 52 on the hosel portion 5 and the rotation position displays 65 of the first adapter can be visually confirmed together with the rotation position of the second adapter 7 by looking at the head 10 from the side opening portion 42 side (heel side), the lie angle and the like of this golf club can be checked at a glance from one direction. Note that the rotation position displays and the reference display are not particularly differentiated, and are not particularly limited as long as the rotation positions can be aligned. That is, any form of display is possible.

Also, the sole opening portion 31 formed in the sole portion 3 is provided in order to insert the washer 8 and the fixing member 9, and thus need only be formed to a size that enables the washer 8 and the fixing member 9 to be inserted along the second axis Y2 of the second adapter 7. Accordingly, the sole opening portion 31 and the adjoining third area 503 of the internal space can be reduced in size. The surface area of the third area 503 thereby decreases and the area of the sole portion 3 increases. Thus, the weight of the head 10 is placed mainly toward the sole surface, enabling a rise in the center of gravity of the head 10 to be suppressed.

5. Variations

Although one embodiment of the present invention has been described above, the present invention is not limited to the above embodiment, and various modifications can be made without departing from the spirit of the invention. For example, the following modifications can be made.

5.1

Figures 9A, 9B, 9C, 9D:
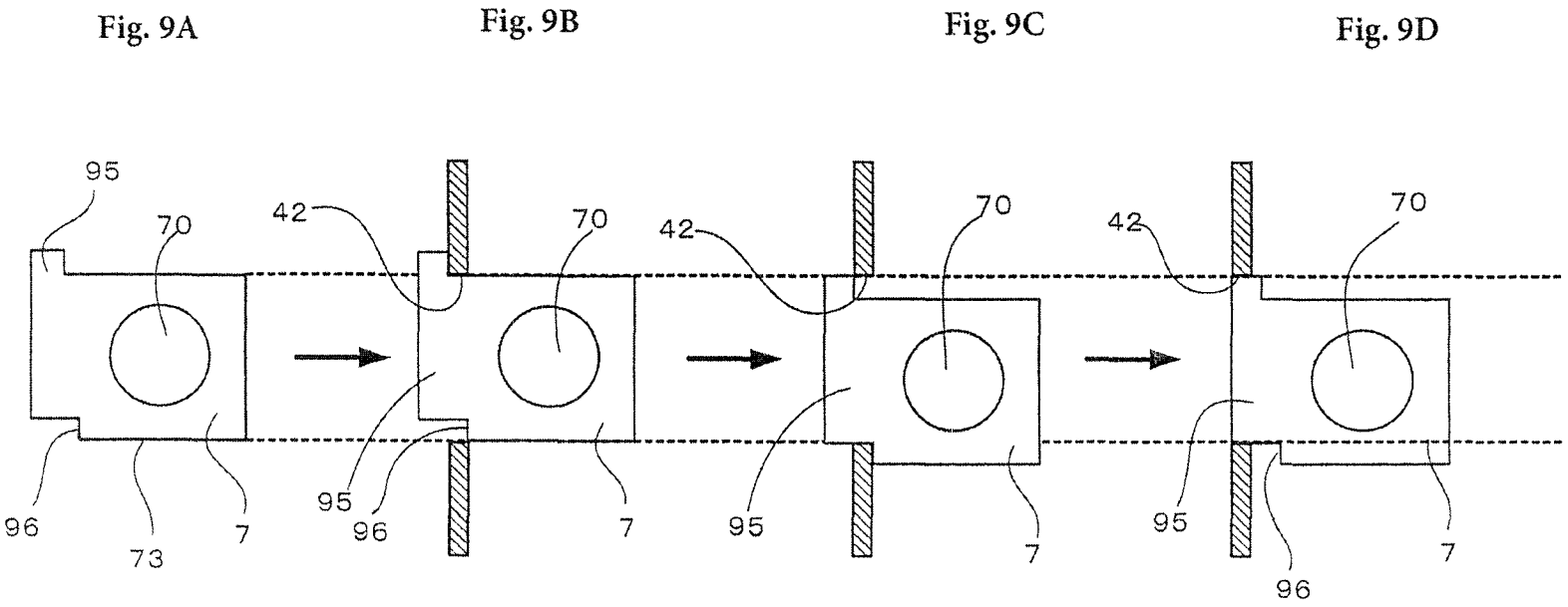
FIGS. 9A to 9D are plan views showing another embodiment of the second adapter.

Various modes of the second adapter 7 are available, and the second adapter 7 can, for example, be configured as shown in FIG. 9, so as to not disengage from the second area 502 of the head toward the side opening portion 42 side. As shown in FIG. 9A, a tabular lid portion 95 is attached to one of the outer peripheral faces of the second adapter 7. This lid portion 95 is the same width as one end portion of the outer peripheral surface 73, and is disposed so as to be shifted from the outer peripheral surface 73. One end portion of the lid portion 95 thereby projects from the outer peripheral surface 73, and a stepped portion 96 is formed with the outer peripheral surface 73 at the other end portion side of the lid portion 95. First, as shown in FIG. 9B, the surface on the opposite side to the side on which the lid portion 95 is attached is inserted through the side opening portion 42. The one end portion of the lid portion 95 that projects from the outer peripheral surface 73 thereby catches on the peripheral edge of the opening in the side opening portion 42. Next, as shown in FIG. 9C, the second adapter 7 is shifted horizontally such that the lid portion 95 is aligned with the side opening portion 42. If the second adapter 7 is then pushed in toward the internal space, the above-mentioned stepped portion 96 acts as a stopper and the second adapter 7 can be prevented from disengaging from the second area 702. With this mode, however, the second adapter 7 cannot take a plurality of rotation positions within the second area 502, and thus only the rotation position of the first adapter 6 is adjusted.

5.2

Figure 10:
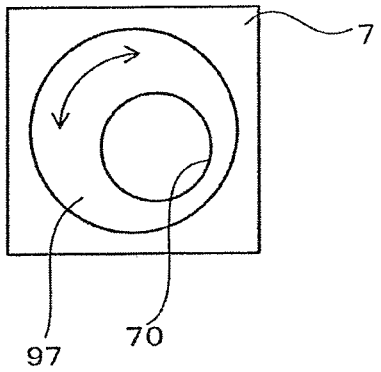
FIG. 10 is a plan view showing another embodiment of the second adapter.

Although, in the above embodiment, the rotation position within the second area 502 is determined by rotating the second adapter 7 itself, a configuration such as shown in FIG. 10, for example, can also be adopted. That is, by rotatably attaching a circular member 97 in which the through hole 70 is formed to the second adapter 7 and rotating this circular member 97, the orientation of the incline of the through hole 70 within the second area 502 can be determined. At this time, the through hole 70 in the circular member 97 can be formed at a position that is eccentrically offset from the center of the circular member 97, for example. Also, adopting such a configuration with the mode shown in FIG. 9 enables the inclination angle of the through hole 70 in the second adapter 7 to be adjusted within the second area 502.

5.3

Figure 11A:
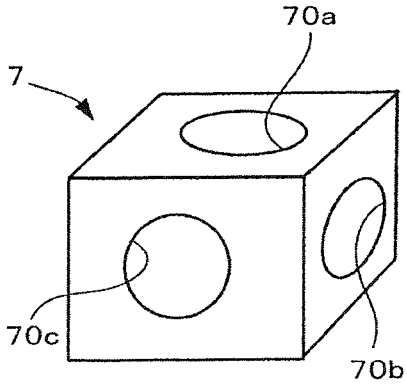
Figure 11B:
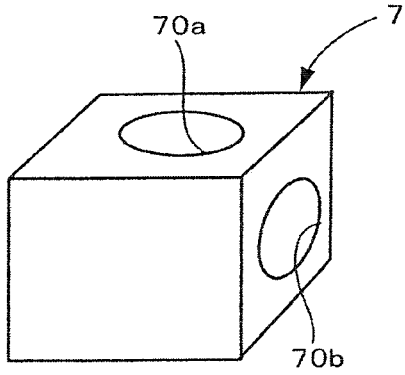

In the above embodiment, the second axis Y2 of the through hole 70 in the second adapter 7 inclines relative to the first axis Y1, and thus rotating the second adapter 7 about the first axis Y1 enabled the inclination angle of the first adapter 6 that is coupled thereto to be changed. In contrast, if through holes into which the coupling portion 62 of the first adapter 6 can be inserted are formed in a plurality of faces of a rectangular parallelepiped second adapter 7 for example, the first adapter 6 and the second adapter 7 can be coupled at even more inclination angles. For example, as shown in FIG. 11A, through holes 70*a*, 70*b* and 70*c* having different inclination angles can be respectively formed in three surfaces of the second adapter. In the example shown in FIG. 11B, through holes 70*a* and 70*b* having different inclination angles are formed in two faces. In this case, the second adapter 7, the second area 502 and the insertion space 41 need to be designed such that the adapter 7 can be inserted in the second area 502 in a state where any of the through holes 70*a*, 70*b* and 70*c* are facing the first area 501. Note that through holes need only be formed in two or three of the external faces of the second adapter 7. Furthermore, it is not necessary for all of the through holes to incline, and at least one through hole may be perpendicular to one of the surfaces.

5.4

Figure 12:
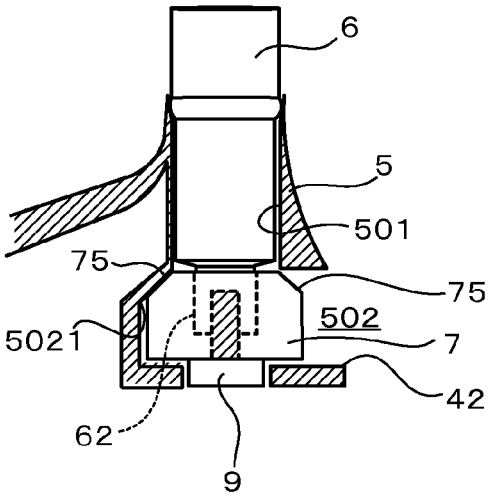
FIG. 12 is a cross-sectional view showing another embodiment of the second adapter and the second area.

Although, in the above embodiment, movement of the second adapter 7 to the attachment hole 51 side in the internal space of the head is regulated by the flange portion 504, the method of regulating movement of the second adapter 7 is not limited thereto. For example, if, as shown in FIG. 12, the length of a traverse section (e.g., horizontal length in FIG. 12) of the second adapter 7 is configured to be greater than the first area 501, and the length of a traverse section of the second area 502 is configured to be greater than the first area 501, movement of the second adapter 7 to the attachment hole side can be restricted, even without providing a flange portion. Other methods may, however, be used as long as movement of the second adapter 7 can be regulated.

5.5

A predetermined clearance may be formed between the second adapter 7 and the second area 502, so as to enable the second adapter 7 to be smoothly housed in the second area 502. Although forming such a clearance enables the second adapter 7 to be smoothly attached and detached, the second adapter 7 could possibly move around inside the second area 502. In view of this, in the above embodiment, the tapered surfaces 75 are formed on the upper surface 71 of the second adapter 7 and are abutted against the tapered surfaces 5021 formed on the inner wall surface of the second area 502. The second adapter 7 can thereby be positioned as a result of the tapered surfaces 75 and 5021 abutting against one another, even without the outer peripheral surface of the second adapter 7 contacting the inner wall surface of the second area 502.

Figure 13:
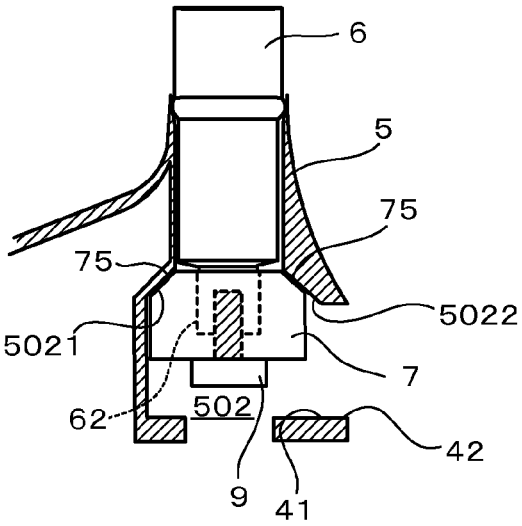
FIG. 13 is a cross-sectional view showing another embodiment of the second adapter and the second area.

Although, in the above embodiment, the tapered surfaces 5021 were formed on three sides of the upper surface of the second area 502 and the insertion space 41, a tapered surface 5022 can also be formed on the side opening portion 42 side, for example, as shown in FIG. 13. In this case, in order to abut the tapered surface 75 of the second adapter 7 against the tapered surface 5022 on the side opening portion 42 side within the second area 502, the second area 502 needs to be lengthened in the axial direction, such that the second adapter 7 is able to move in the axial direction to the first area 501 side after being inserted in the second area through the insertion space 41.

Note that the tapered surfaces 75 of the second adapter 7 and the tapered surfaces 5021 and 5022 of the second area 502 and the insertion space 41 are not necessarily required, and positioning can be performed using the outer peripheral surface of the second adapter and the inner wall surface of the second area 502 and the insertion space 41.

5.6

In the above embodiment, the second adapter 7 and the fixing member 9 are separate members, but these members can also be integrated. That is, the fixing member 9 can be rotatably attached to the lower surface 72 side of the second adapter 7. This enables the adapter 7 and the fixing member 9 to be inserted as a set through the side opening portion 42. In this case, the head portion 91 of the fixing member 9 can also be prevented from projecting outside by being housed in a recessed portion formed in the lower surface of the second adapter 7.

5.7

Although, in the above embodiment, the second adapter 7 is formed in a rectangular parallelepiped shape and the second area 502 in the internal space of the head 10 is formed to have a corresponding shape, the present invention is not limited thereto. That is, the shapes of these members is not particularly limited as long as the second adapter 7 can be housed in the second area 502 of the head in a plurality of rotation positions. For example, the second adapter 7 can also be formed to be polygonal in plan view. Alternatively, the second adapter 7 can also be housed in the second area 502 in a plurality of rotation positions, by forming the second adapter 7 to be circular in plan view and to have at least one protruding portion or recessed portion, and by engaging this protruding portion or recessed portion in the second area 502. Furthermore, the shape of the second adapter 7 and the internal shape of the second area 502 need not be the same, as long as the second adapter 7 can be housed in the second area 502 in a plurality of rotation positions, as described above. For example, a configuration can also be adopted in which the second area 502 is formed in a rectangular parallelepiped shape, and the second adapter 7 is formed in an octagonal shape in plan view.

5.8

At least one third adapter in which the inclination angle of the through hole 70 is different from the second adapter 7 of the above embodiment can also be prepared. This third adapter has the same configuration as the second adapter 7 apart from the inclination angle of the through hole 70. Note that the inclination angle of the through hole in this third adapter may be zero degrees. If such a third adapter is prepared, the shaft 20 and the head 10 can be coupled at an even wider variety of inclination angles. In this case, a configuration may be adopted in which whichever of the second adapter 7 or the third adapter is not housed in the internal space of the head 10 can be utilized to weight the head, for example. That is, a recessed portion can be formed in the surface of the head 10, and the second adapter or the third adapter that is not being utilized can be prevented from being lost by being housed in this recessed portion.

In this case, a fixing member for the third adapter is prepared, enabling the third adapter to also be fixed within the recessed portion by this fixing member. A configuration can also be adopted in which the position of the center of gravity is adjusted by respectively forming the second adapter 7 and the third adapter with materials having different specific gravities, and disposing the recessed portion at a position separated from the internal space of the head 10, such as on the sole portion 3 or on the toe side or the back side of the side portion 4, for example. The member for adjusting the angle of the shaft 20 can thereby also double as a member for adjusting the center of gravity. In this case, a configuration can also be adopted in which a plurality of third adapters are prepared, with, for example, at least one having a different inclination angle of the through hole from the second adapter 7, and at least one having the same inclination angle of the through hole as the second adapter 7 but a different specific gravity.

5.9

Although, in the above embodiment, the coupling portion 62 of the first adapter 6 is formed in a square tubular shape, and the first area 701 of the through hole 70 in the second adapter 7 is similarly formed in a square tubular shape, so as to enable both adaptors to be coupled in four rotation positions, the present invention is not limited thereto. That is, the coupling portion 62 can also be formed in a polygonal tubular shape and coupled in a number of rotation positions other than four. Also, by forming the coupling portion 62 in a cylindrical shape having a protruding portion extending in the axial direction and forming a groove in the inner wall surface of the first area 701, both adapters can be splined together.

5.10

Also, although, in the above embodiment, the coupling portion 62 of the first adapter 6 is formed as a protruding portion and the through hole 70 for accepting this coupling portion 62 is formed in the second adapter 7, the structure for coupling both adapters is not limited thereto. For example, a tubular protruding portion can be formed on an upper end portion of the second adapter 7, and a recessed portion for accepting this tubular protruding portion can be formed in a lower end portion of the first adapter 6. That is, the first coupling portion of the first adapter 6 and the second coupling portion of the second adapter in the present invention can be coupled in various modes.

5.11

Although, in the above embodiment, the shaft 20 is inclined at one degree to the first adapter 6 and the first adapter 6 is inclined at one degree to the second adapter 7, these angles are not particularly limited. Also, these two angles may be differentiated from one another.

5.12

Figure 14:
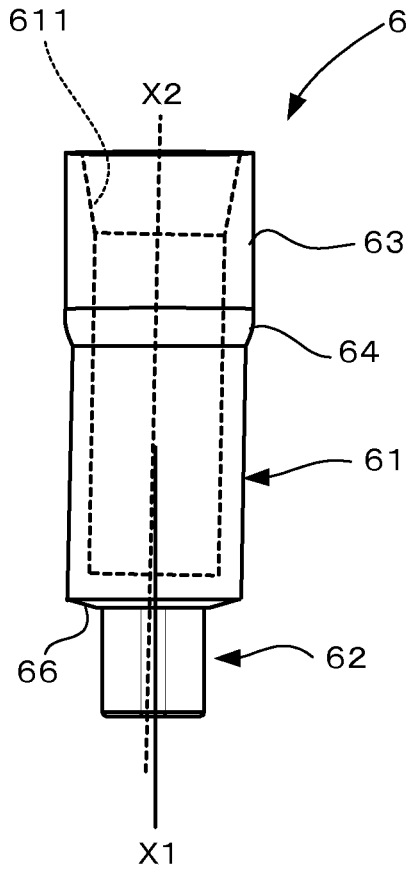
FIG. 14 is a side view showing another example of the first adapter.

Although, in the above embodiment, the outer peripheral surface of the first adapter 6 is formed in parallel to the first axis X1 and the shaft-insertion recessed portion 611 is formed along the second axis X2 intersecting the first axis X1, the first adapter 6 can also be formed as shown in FIG. 14, for example. As shown in this diagram, in this example, the main body portion 61 of the first adapter 6 is inclined relative to the coupling portion 62. That is, the coupling portion 62 is formed to extend along the first axis X1, and the outer peripheral surface of the main body portion 61 is formed along the second axis X2. The shaft-insertion recessed portion 611 that is formed in the main body portion 61 is also formed to extend along the second axis X2. Since the axial center S of the shaft 20 extends along the second axis X2, the shaft 20 can also be fixed at an angle to the first adapter 6 with this configuration. The coupling portion 62 of the first adapter 6 is thereby configured to be coupled at an angle to the through hole 70 in the second adapter 7.

5.13

The golf club head configured as described above has a hollow structure, and thus is generally manufactured by joining two or more members together. That is, the head is manufactured by joining a head main body in which one or more openings that pass through the hollow portion are formed to separate members that close the one or more openings. For example, the head can also be configured by constituting only the crown portion 2 and the face portion 1 with separate members and combining these members with the head main body, or by forming a head main body in which openings are provided in the sole portion 3 and the side portion 4 and closing these openings with separate members. Such a head main body can be manufactured by casting such as well-known lost wax precision casting, for example. Recent technical developments also make it possible for a golf club head having a hollow structure to be integrally molded as a single part using a 3D printer, metal injection molding or the like.

Although the above embodiment was described taking a wood-type golf club as an example, the present invention is also applicable to an iron-type golf club. That is, the coupling structure of the present invention is applicable by forming the above-mentioned internal space in a head that does not have a hollow structure such as the head of an iron. In particular, given the small area of the sole portion of iron-type golf clubs, it is advantageous to employ the coupling structure of the present invention, which is able to reduce the size of the sole opening portion 31 that is formed in the sole portion.

5.14

Although, in the above embodiment, the side opening portion 42 that houses the second adapter is formed in the side portion 4 of the head, this opening portion can be formed at any position between the attachment hole 51 in the hosel portion 5 and the sole opening portion 31 formed in the sole portion 3, and is not limited to the side portion 4.

REFERENCE SIGNS LIST

10 golf club head
20 shaft
31 sole opening portion (second opening portion)
42 side opening portion (third opening portion)
5 hosel portion
51 attachment hole (first opening portion)
6 first adapter
7 second adapter
9 fixing member

The invention claimed is:

1. A golf club comprising:

a shaft;

a golf club head including a sole portion and a hosel portion that has a first opening portion in which the shaft is to be attached, and having an internal space that extends from the first opening portion to the sole portion side, with the internal space being open at a second opening portion formed in the sole portion;

a first adapter having a first end portion and a second end portion, and configured to be inserted into the first opening portion, the first adapter having, at the first end portion side, a shaft-insertion recessed portion in which the shaft is to be fixed and having, at the second end portion, a first coupling portion;

a second adapter configured to be housed in the internal space and having a second coupling portion configured to be detachably coupled to the first coupling portion of the first adapter; and a fixing member configured to be housed in the internal space through the second opening portion, and to detachably fix the second adapter to the first adapter, wherein the internal space includes a housing portion configured to house the second adapter, the housing portion is configured to regulate movement of the second adapter, a third opening portion that communicates with the housing portion and through which the second adapter is to be inserted is formed in a surface of the golf club head between the first opening portion and the second opening portion, the first coupling portion of the first adapter is configured to incline relative to the shaft, the second coupling portion of the second adapter is configured such that the first adapter is coupled at an angle to the second adapter, the first coupling portion of the first adapter and the second coupling portion of the second adapter are configured to be coupled in a plurality of rotation positions, and the second adapter is configured to be housed within the housing portion in a plurality of rotation positions.

2. The golf club according to claim 1, wherein the first adapter has the first end portion and the second end portion at either end portion of a first axis and is formed in a tubular shape along the first axis, and the shaft-insertion recessed portion extends along a second axis that intersects the first axis, the second adapter has a first end portion that faces the first opening portion side and a second end portion that faces the second opening portion side, the first end portion and the second end portion are provided at either end portion of a first axis, and the second coupling portion is formed along a second axis that intersects the first axis, the first coupling portion of the first adapter and the second coupling portion of the second adapter are configured to be coupled in a plurality of rotation positions about the second axis of the second adapter, and the second adapter is configured to be housed within the housing portion in a plurality of rotation positions about the first axis of the second adapter.

3. The golf club according to claim 2, wherein the first coupling portion of the first adapter has a tubular protruding portion, and the second coupling portion of the second adapter has a recessed portion that is configured to accept the first coupling portion of the first adapter.

4. The golf club according to claim 1, wherein the second adapter is formed to have an outer peripheral surface having a polygonal shape in cross section, and is configured to be housed in a plurality of rotation positions with at least two faces of the outer peripheral surface abutting within the housing portion.

5. The golf club according to claim 1, wherein, in the second adapter, a coupling position with the first coupling portion of the first adapter is disposed in a position shifted from a center of the plurality of rotation positions within the housing portion.

6. The golf club according to claim 1, wherein the second adapter is configured to be positioned by the surface facing the first opening portion side abutting against an inner wall surface within the internal space.

7. The golf club according to claim 1, further comprising:

at least one third adapter configured to be coupled to the first coupling portion of the first adapter at a different inclination angle from the second adapter, wherein the at least one third adapter is configured to be inserted through the third opening portion and housed in the internal space, and to be coupled to the first adapter by the fixing member.

8. The golf club according to claim 1, further comprising:

at least one third adapter configured to be coupled to the first coupling portion of the first adapter at the same inclination angle as the second adapter and having a different weight from the second adapter, wherein the at least one third adapter is configured to be inserted through the third opening portion and housed in the internal space, and to be coupled to the first adapter by the fixing member.

9. The golf club according to claim 7, wherein the golf club head includes at least one recessed portion configured to house the second and third adapters.

* * * * *